US005665932A

United States Patent [19]

Viljoen et al.

[11] Patent Number: 5,665,932

[45] Date of Patent: Sep. 9, 1997

[54] INITIATION OF BLASTING

[75] Inventors: Johanna Catharina Viljoen, Doringkloof; Jéan Pierre Jordan Le Roux, Saiccervillage, both of South Africa

[73] Assignee: AECI Explosives Limited, Johannesburg, South Africa

[21] Appl. No.: 167,553

[22] Filed: Dec. 14, 1993

[30] Foreign Application Priority Data

Dec. 18, 1992 [ZA] South Africa ..... 92/9863

[51] Int. Cl.[6] ..... C06C 5/06

[52] U.S. Cl. ..... 102/275.7; 102/275.5; 102/275.6; 102/275.11; 102/275.12; 102/312

[58] Field of Search ..... 102/275.2, 275.3, 102/275.4, 275.5, 275.6, 275.7, 275.8, 275.11, 275.12, 304, 312

[56] References Cited

U.S. PATENT DOCUMENTS 927,968 7/1909 Harle ..... 102/275.4

4,350,097 9/1982 Bowman et al. ..... 102/275.2

5,204,492 4/1993 Jacob et al. ..... 102/275.12

FOREIGN PATENT DOCUMENTS 175918 3/1922 United Kingdom ..... 102/275.6

*Primary Examiner*—Stephen M. Johnson

*Attorney, Agent, or Firm*—Charles Q. Buckwalter

[57] ABSTRACT

The invention provides a method for the initiation of blasting. The method comprises the steps of initiating a detonation in an initial shock robe and causing the detonation to propagate along the interior of the shock robe. The detonation in the initial shock tube initiates a detonation in a high explosive charge in a connection device whereby the shock tube is connected to a plurality of further shock tubes. The detonation of the high explosive charge acts to transfer the detonation from the initial shock tube to the further shock tubes to initiate detonations therein. The transfer of the detonations from the initial shock tube to the further shock tubes is effected in a direction which is radial relative to the initial shock tube and radial relative to the further shock tube. The invention also provides a system for the initiation of blasting.

1 Claim, 5 Drawing Sheets

INITIATION OF BLASTING

THIS INVENTION relates to the initiation of blasting. More particularly it relates to a method and system for the initiation of blasting suitable for, but not restricted to, permitted use in fiery environments such as those which exist in coal mines; and it relates to novel components of the system.

According to one aspect of the invention there is provided a method for the initiation of blasting which comprises the steps of:

initiating a detonation in an initial shock tube and causing the detonation to propagate along the interior of the shock tube;

initiating, by means of said detonation in the initial shock tube, a detonation in a high explosive charge in a connection device whereby the shock tube is connected to a plurality of further shock robes, the detonation of the high explosive charge acting to transfer the detonation from the initial shock tube to the further shock tubes to initiate detonations therein; and propagating the detonations in the further shock tubes along their interiors from the connection device separately to charges of explosive in boreholes and initiating blasting of said charges by means of said separately propagated detonations, the transfer of the detonation from the initial shock tube to the further shock tubes being effected in a direction which is radial relative to the initial shock tube and radial relative to the further shock tubes.

After the detonation has been transferred from the initial shock tube to the further shock robes, it may be propagated along the further shock tubes in the same direction as the propagation of the detonation along the initial shock tube, or in the opposite direction.

According to another aspect of the invention there is provided a system for the initiation of blasting which comprises:

an initial shock tube having, at one end thereof, an initiator connected thereto for the initiation of a detonation therein which propagates along its interior;

a connection device for connecting the initial shock tube, at a position remote from the initiator, to a plurality of further shock tubes and for transferring the detonation from the initial shock tube to the further shock tubes; and a plurality of further shock tubes for connection via the connection device to the initial shock tube, each for receiving a detonation transferred from the initial shock tube thereto via the connection device and for propagating the detonation to a charge of explosive in a borehole, the connection device being constructed so that it comprises a high explosive charge for connection to, and initiation by, the initial shock tube at a position remote from the initiator, and so that it is capable of holding a plurality of said further shock tubes in close proximity to the high explosive charge and arranged so that, where they are held by the connection device, they are parallel to the initial shock tube where it is connected to the high explosive charge and spaced radially therefrom, and so that any transfer of a detonation from the initial shock tube to the further shock tubes takes place in a direction which is radial relative to the initial shock tube and radial relative to the farther shock tubes.

The high explosive charge of the connection device may be in the form of a base charge or detonator.

As mentioned above, after the detonation has been transferred from the initial shock tube to the further shock tubes, it may be propagated along the further shock tubes in the same direction as the propagation of the detonation along the initial shock tube, or in the opposite direction.

Preferably the shock tube is a permitted shock tube. The shock tube may, for example, be of the type described in British Patent 2242010. By permitted is meant a product suitable for use in fiery mines, such as underground coal mines, where excessive amounts of methane gas and/or coal dust may be present.

The initiator may be a fuse head or header, being, for example, an electrically initiated header which may be of a type based on polymer thick film technology or ceramic thick film technology, eg as described in the Applicant's co-pending South African Patent Application 93/6130. Thus, according to the method, initiating the detonation in the initial shock tube may be effected electrically, using said header.

Instead, the initiator may be of the type described in South African patent 87/0783, modified, if necessary, to provide it with sufficient energy to initiate the initial shock tube; and the method thus contemplates using this initiator to initiate the initial shock tube.

Instead, the system and method may employ detonating cord, such as low energy detonating cord or permitted detonating cord when the initial shock tube is permitted shock tube. This detonating cord can be connected to the shock tube in conventional fashion, using a suitable clip such as that available from the Applicant under the Trade Mark 'COBRA' for connecting detonating cord to standard high energy shock tube such as the shock tube having a core comprising HMX (also known as cyclotetramethylene tetranitramine or octogen explosive) and aluminium, and available from the Applicant under the Trade Mark 'NONEL'.

A further possibility for the system and method is to use a detonator to initiate the initial shock tube, eg a permitted detonator such as that available from the Applicant under the Trade mark 'STATSAFE CARRICK', which can be detonated in a short hole, eg in a coal face, suitably stemmed for permitted use.

In a particular embodiment of the invention the connection device may be in the form of an assembly in which the high explosive charge is in the form of a detonator having an end connected to the end of the initial shock tube, at the end of the initial shock tube remote from the initiator, the assembly comprising a securing strap for strapping the further shock tubes to the detonator, so that the further shock tubes are circumferentially disposed around the detonator, and so that each further shock tube extends alongside the detonator and alongside the initial shock tube, substantially parallel thereto. The assembly may include a stem, which may be of polymeric plastics or elastomeric material, fast with the detonator, the stem projecting axially away from the end of the detonator remote from the initial shock tube, the stem having an end remote from the detonator fast with a floor of a cup for receiving the ends of the further shock tubes, said remote end of the stem being located at a radially central position in the interior of the cup. In use the further shock tubes will be strapped around the detonator by the strap, with theft adjacent free ends received in and held captive by the cup. The assembly as a whole can then be inserted, cup first, into a short borehole, eg in a coal face, which can then be stemmed as required, the initial shock tube entering the borehole via the stemming and the further shock tubes issuing from the borehole via the stemming and leading to explosives charges respectively to be initiated thereby, eg via suitable, and optionally permitted, detonators and/or booster/primer charges. Upon detonation of the detonator after initiation thereby by the initial shock tube, the detonation will be transferred in a radial direction from the detonator to the further shock tubes held around the detonator by the strap, in which further shock tube detonations will be initiated thereby which propagate along their interiors away from the detonator and cup. The detonation front in the further shock tubes will in this case propagate in the opposite direction to the detonation front of the initial shock tube.

In another particular embodiment of the invention the connection device may be in the form of a body of polymeric material which has a hollow interior formed by a passage having an end opening out of the body, the high explosive charge being in the form of a base charge and the passage having the base charge, for example a lead azide charge, located in a blind end thereof in the interior of the body, and the body having at least one clip fast therewith, the clip being arranged so that it is resiliently movable away from the body to permit at least one shock tube to be inserted between the clip and the body, to extend parallel to the passage, and the clip being arranged, after subsequent release thereof, to clip the shock tube to the body. The passage may be lined by a metal can or tube, eg of copper or aluminium, having a closed inner end, and having an outer end projecting from the body and being provided with a plug, eg of NEOPRENE rubber, the plug having a central opening for receiving the end of the initial shock tube remote from the initiator, and the can or tube, at its open end, being crimped to the plug. In use the end of the initial shock tube remote from the initiator will be plugged into said plug, and at least one further shock tube will be clipped to the body by each clip. A detonation propagated along the initial shock tube from the detonator will detonate the high explosive charge and the detonation of the charge will be transferred, radially relative to the passage and relative to the shock tubes, to the further shock tubes, where it will initiate detonations therein.

From the connection device the further shock tubes will extend, typically, to a face such as a coal mine face which is to be blasted, and which has boreholes therein which contain explosives charges which are to be blasted. The explosives in this case may be permitted packaged explosives such as those available from the Applicant under the trade marks 'AJAX', 'COALEX' and 'POWERGEL', detonated by means of suitable permitted detonators such as 'STATSAFE CARRICK' detonators; or a permitted emulsion explosive may be used, such as that described in the Applicant's South African patent 90/4504, detonated by a suitable permitted booster such as that described in the Applicants' South African patent 92/6089.

The invention extends to a connection device for forming part of a system as described above, the connection device being in the form of an assembly comprising a detonator for connection, at an end thereof, to an end of a shock tube, and a securing strap for strapping further shock tubes to the detonator, so that the further shock tubes are circumferentially disposed around the detonator, and so that each further shock tube extends alongside the detonator and the initial shock tube, substantially parallel thereto.

The assembly may include a stem fast with the opposite end of the detonator, the stem projecting axially away from said opposite end, the stem having an end remote from the detonator and fast with the floor of a cup for receiving the ends of the further shock tubes, said remote end of the stem being located at a radially central position in the interior of the cup.

The invention extends also to a further connection device for forming part of a system as described above, the connection device being in the form of a hollow body of polymeric material which has a hollow interior formed by a passage having an end opening out of the body, the passage containing a high explosive base charge located in a blind end of the passage in the interior of the body, and the body having at least one clip fast therewith, each said clip being arranged so that it is resiliently movable away from the body to permit at least one shock tube to be inserted between the clip and the body, to extend parallel to the passage, and the clip being arranged, after subsequent release thereof, to clip each said tube to the body.

The passage may be lined by a metal can or tube being closed at its inner end, and having an outer end projecting from the body and being provided with a plug, the plug having a central opening for receiving an end of a shock tube, and the can or tube at its open end being crimped to the plug.

The invention will now be described, by way of example, with reference to the trials described hereunder which have conducted by the Applicant, and with reference to the accompanying diagrammatic drawings, in which.

Figure 3:
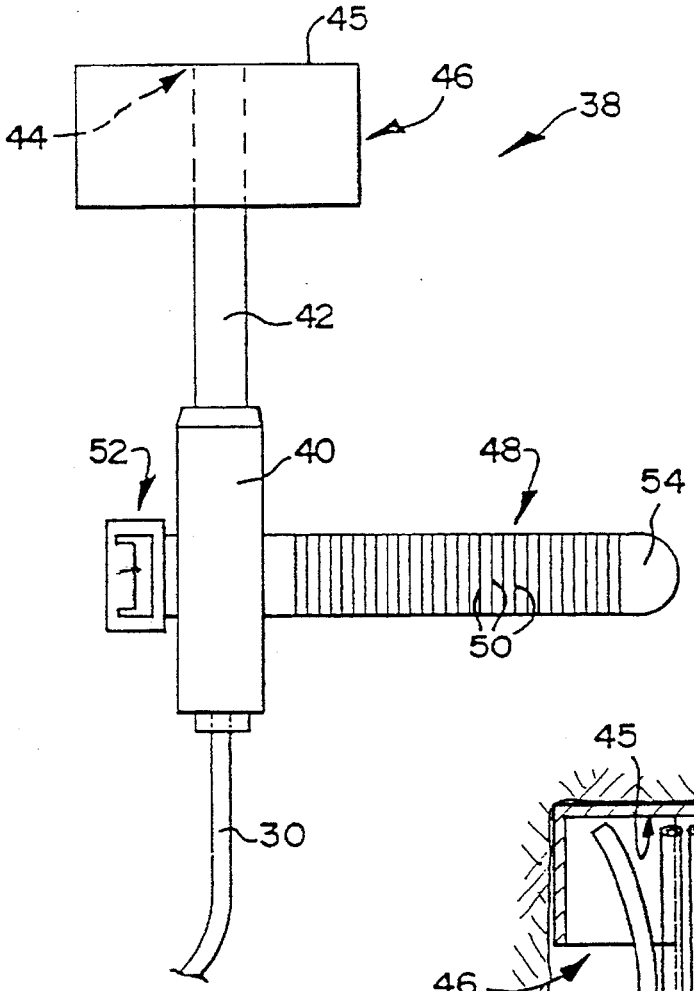
FIGS. 3 and 4 show a connection device in accordance with the present invention respectively in an unassembled condition, and in an assembled condition connecting an initial shock robe to further shock robes, in schematic side elevation.
Figure 4:
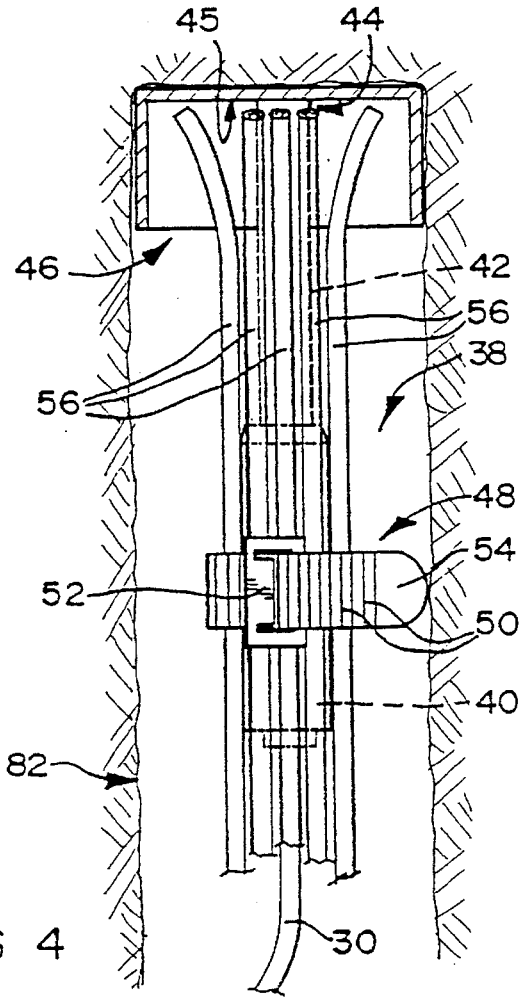
Figure 5:
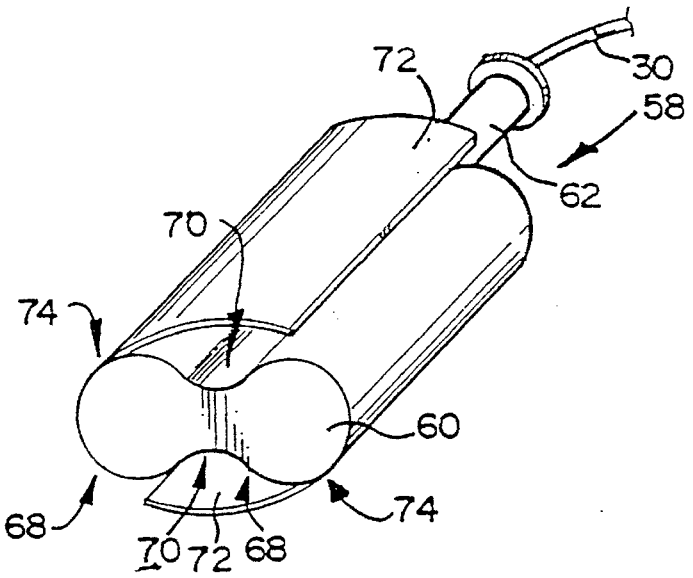
FIGS. 5, 6 and 7 show another connection device in accordance with the present invention, respectively in a three dimensional view, end elevation and sectional side elevation.
Figure 6:
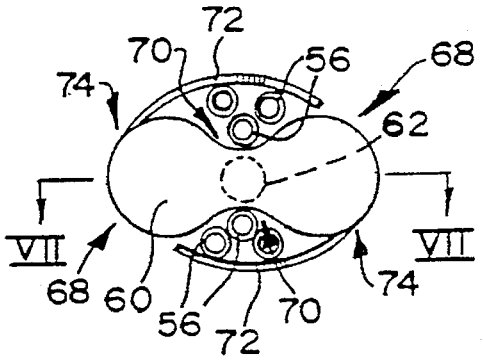
Figure 7:
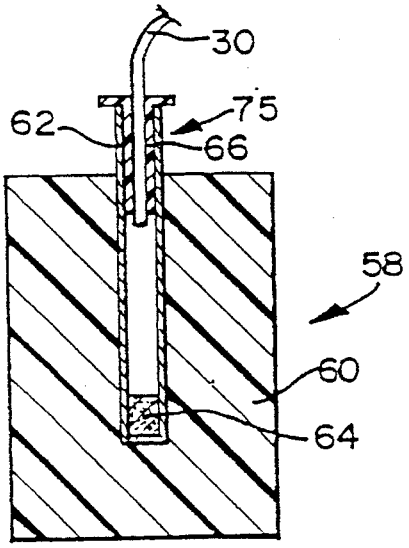
Figure 8:
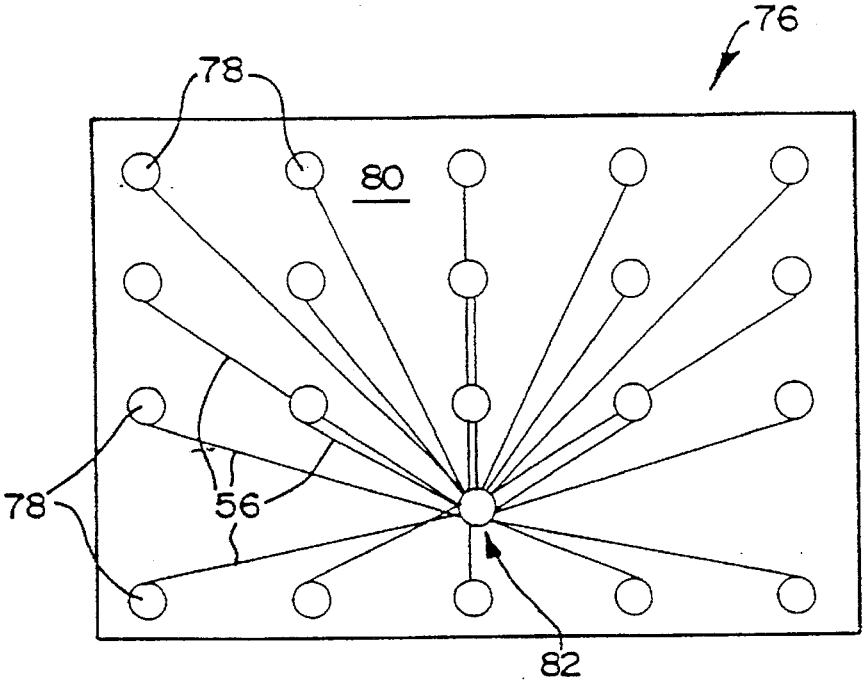
Figure 9:
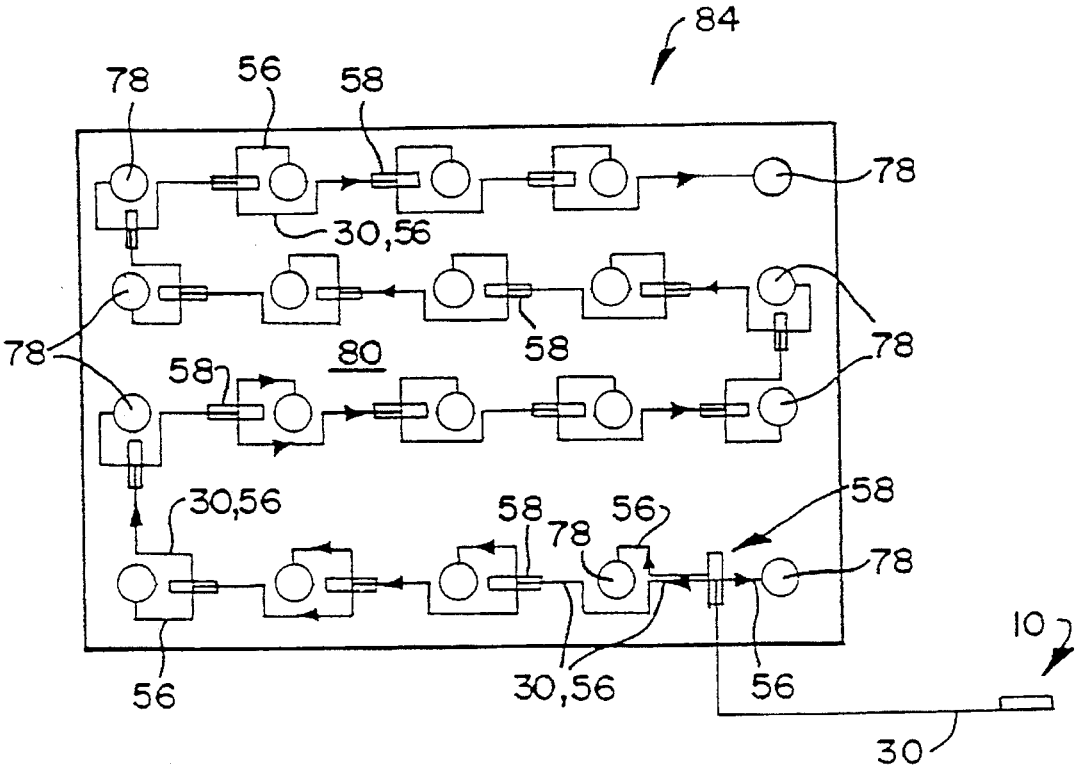
Figure 10:
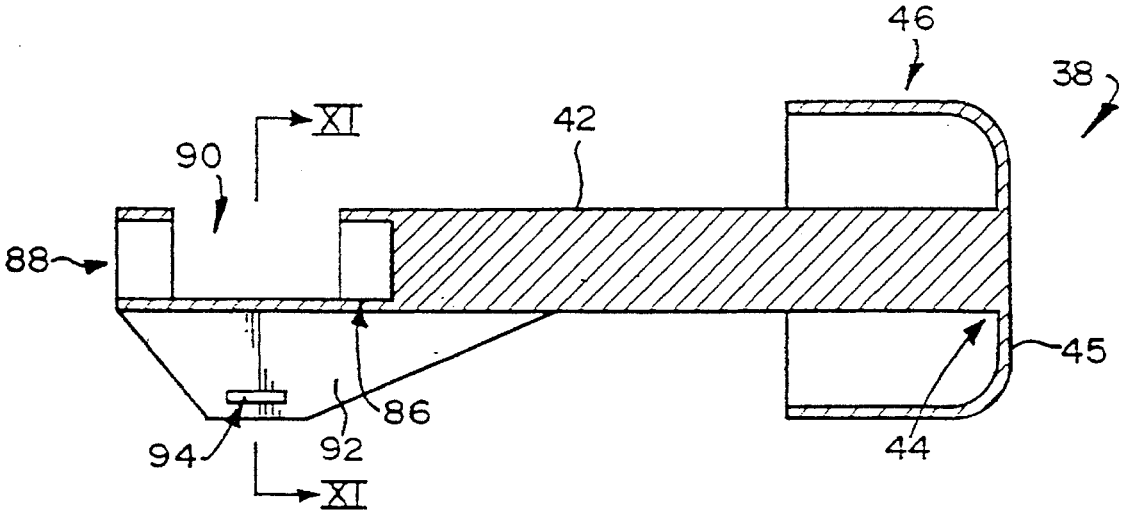
Figure 11:
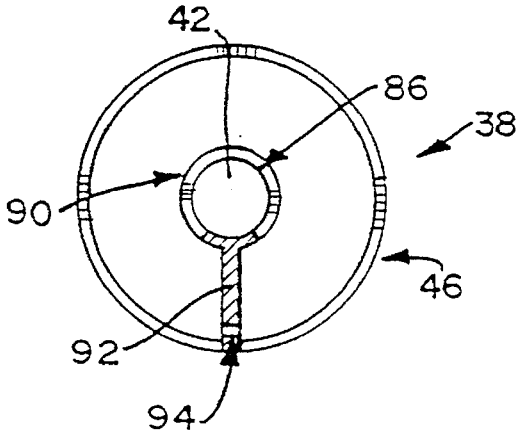

FIGS. 8 and 9 show schematic blasting layouts for the method and system of the present invention, employing respectively the connection device of FIGS. 3 and 4 on the one hand, and the connection device of FIGS. 5, 6 and 7 on the other; and FIGS. 10 and 11 show respectively a sectional side elevation and a sectional end elevation, along line XI—XI in FIG. 10, of a developed version of the connection device of FIGS. 3 and 4.

Figure 1:
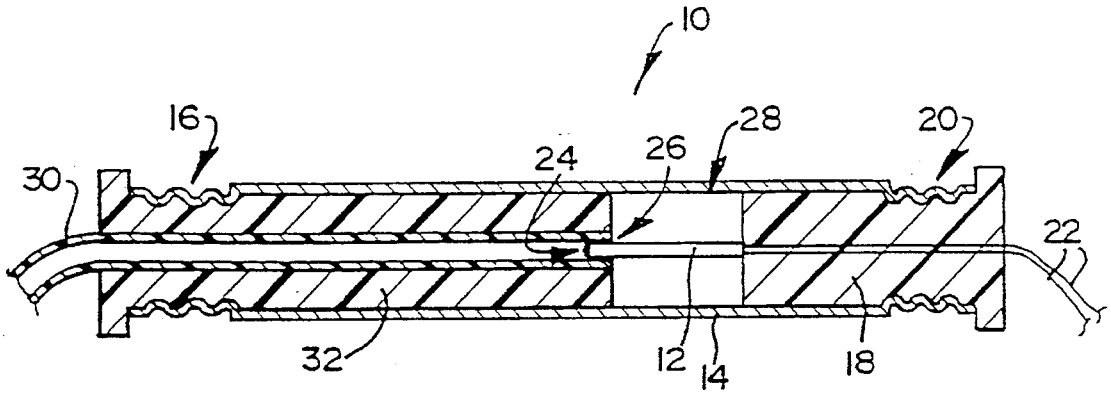
FIGS. 1 and 2 show respectively schematic sectional side elevations of lengths of shock tube connected to electrically initiated headers of the type described in South African Patent Application 93/6130, and forming part of the system of the present invention.
Figure 2:
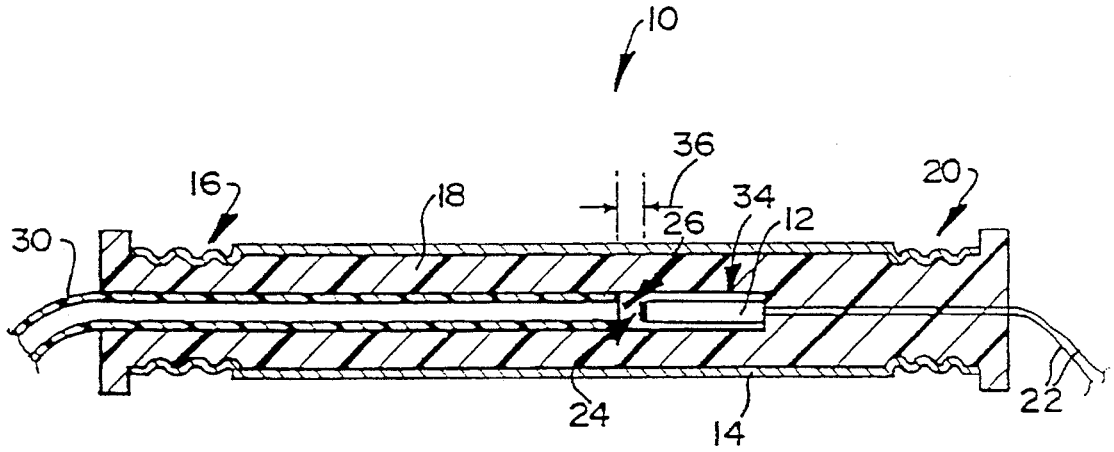

In FIGS. 1 and 2 reference numerals 10 generally designate respective initiating assemblies in which a header 12 based on polymer- or ceramic thick film technology of the type described in South African Patent Application 93/6130 is shown connected to an initial shock robe. In each case the assembly comprises an aluminium tube 14 crimped at one of its ends at 16 to a NEOPRENE rubber plug. The tube 14 is also crimped to a NEOPRENE rubber plug 18 at its other end at 20. The header 12 has two leg wires 22 which pass respectively through suitably narrow passages therefor in the plug 18. The header 12 is elongated, and at its free end, remote from its end which is connected to the leg wires 22, it has a coating or layer 24 of polymer- or ceramic thick film, In FIGS. 1 and 2 a length of permitted shock tube is shown having one end thereof located in the interior of the tube 14 at 26. In FIG. 1 there are two NEOPRENE rubber plugs, one of which is the plug 18, spaced apart by a space 28, and in FIG. 2 there is a single plug of split construction, being diametrically split across its breadth. The plug extends the full length of the tube 14, and is designated 18.

In FIG. 1 the shock tube is designated 30 and the further NEOPRENE plug is designated 32. The plug 32 has a central passage in which the tube 30 is fixed, eg frictionally or by adhesive, so that its end at 26 is located at the inner end of the plug 32. The header 12 is held in the space 28 by the plug 18 via its leg wires 22, so that its free end with the layer 24 is located inside the end 26 of the tube 30.

In FIG. 2 the plug 18 has a passage extending along a major portion of its interior, in which the tube 30 is fast. The tube 30 however stops with its end 26 short of the inner end of said passage, leaving a space 34 in which the header 12 is located with its layer or coating 24 outside the end 26 of the tube 30. In this regard the split of the plug 18 intersects space 34, to permit insertion of the header 12 into the space 34. The layer or coating 24 is spaced from the end 26 of the tube 30 by a short stand-off spacing 36, of less than 10 mm, the coating being aimed axially at the end or mouth of the shock tube.

Turning to FIGS. 3 and 4, the assembly shown there is generally designated 38, the initial shock tube again being designated 30. The end of the shock tube 30 remote from the assembly 10 (see FIGS. 1 and 2) is shown, connected to a permitted detonator 40, which is a STATSAFE CARRICK detonator.

The assembly 38 includes a stem 42, fast with the detonator 40 at the end of the detonator remote from the tube 30. The end of the stem 42 is fast at 44 at a central position with the floor 45 of a cup 46. The assembly 38 further comprises a securing strap 48, shown in an unsecured condition in FIG. 3 and in a secured condition in FIG. 4. It is relatively broad and is of the type used for securing together bundles of electrical leads, having serrations at 50 and an eye 52 at one end through which its opposite end 54 can pass to form a loop, the serrations 50 resisting withdrawal of the end 54, from the eye 52, in non-return fashion.

In FIG. 4 a plurality of further such shock tubes 56, which, like the initial shock tube 30, are in accordance with British Patent 2242010, are strapped by the strap 48 to the detonator 40, so that they form a series which encircles the detonator 40, and the tubes 56 being circumferentially disposed around the detonator. The tubes 56 each extend alongside the detonator 40 parallel to the detonator 40 and tube 30, being arranged so that they have their adjacent free ends located in the interior of the cup 46, adjacent its floor 45, where they are held captive in a neat bundle by the cup 46.

Turning to FIGS. 5–7 another connection device is designated by reference numeral 58. The device 58 has a body 60 of polymeric material, which body is elongated and broadly of FIG.-8 outline in end elevation (see FIG. 6). The body 60 has a central passage provided by a metal can or tube 62, closed at its inner or blind end, where a lead azide high explosive charge 64 is located. The opposite end of the can or tube 62 protrudes from the body 60 and is fitted with a NEOPRENE rubber plug 66. The FIG.-8 outline of the body 60 provides it with a flattened shape having two elongated lobes 68 separated by two indentations or valleys 70; and each valley 70 is enclosed by a clip 72 in the form of a flange of polymeric material which is resiliently flexible and is fast along an edge thereof at 74 with the body 60. Each flange 72 is resiliently movable away from the body 60 about its edge 74 to permit a plurality of further shock tubes 56 to be inserted thereunder, in the associated valley 70, to be resiliently clipped there and held in position there by the flange 72. An initial shock tube 30 is shown inserted into the plug 66, which has a central passage for this purpose, the tube 62 being crimped (not shown) at 75. In use each tube 56 is typically clipped by the associated flange 72, adjacent one end of the tube 56, the tube 56 leading away from the device 58 to a charge of explosive to be blasted.

FIG. 8 shows a schematic layout used in a trial to test the feasibility of the system and method of the present invention. The layout is generally designated 76 and comprises a plurality of boreholes 78 for containing explosives charges for blasting a coal face 80. The coal face has a short borehole 82 in which, suitably stemmed, is located a connection device (not shown) according to FIGS. 3 and 4, to which leads an initial shock tube 30 (see FIGS.3 and 4-also not shown). A plurality of further shock tubes 56 lead from the connection device in the borehole 82, to detonators (not shown) in the boreholes 78. The inner end of the borehole 82 is shown in FIG. 4.

In the case of FIG. 9, the same reference numerals are used to designate the same parts as in FIG. 8, unless otherwise specified, the layout of FIG. 9 being designated 84. An initiating assembly 10 (see FIGS. 1 and 2) is shown, connected to an initial shock tube 30, which leads to a first connection device 58 (see FIGS. 5–7). Two further shock tubes 56 lead respectively to two adjacent boreholes 78. Unlike FIG. 8, where the further shock tubes 56 connect the borehole 82 to the boreholes 78 in parallel, the further shock tubes 56 connect the boreholes 78 together in series. Thus, the first connection device 58 which is connected by the initial shock tube 30 to the initiating assembly 10, is located between the first and second boreholes 78 in the series, being connected to the first borehole 78 by a further shock tube 56, being connected to the second borehole 78 by a further shock tube 56 and being connected to the third borehole in the series via another connection device 58 by a shock tube designated 30,56, as it functions as an initial shock tube 30 for said other connection device 58, and as a further shock tube 56 in respect of the first connection device. This arrangement is repeated along the series of boreholes 78 so that, between each adjacent pair of boreholes in the series, there is a connection device 58 having its inlet shock tube 30 leading thereto from the previous connection device 58, one further shock tube 56 leading therefrom to the succeeding connection device 58, and one further shock tube 56 leading to the adjacent borehole 78. In other words, a plurality of devices 58 are connected together in series by shock tubes 30,56, there being one device 58 for each borehole 78, each device 58 being connected to the associated borehole 78 by an associated shock tube 56, each device 58 being connected to the preceding device 58, and to the succeeding device 58, by a separate shock tube 30,56 which functions as an initial shock tube 30 for the device 58 at its downstream end, and as a further shock tube 56 for the device 58 at its upstream end.

In FIGS. 10 and 11, the same reference numerals designate the same parts as designated thereby in FIGS. 3 and 4 unless otherwise specified. The assembly 38 is shown with the detonator 40, strap 48 and tube 30 (see FIGS. 3 and 4) omitted for ease of illustration. The end of the stem 42 remote from the cup 46 is provided with a socket 86 having a mouth 88, for receiving and frictionally engaging a detonator (see 40 in FIGS. 3 and 4). A radial window 90 is provided into the socket 86. The stem 42 further includes, fast therewith, a flange 92 extending longitudinally along the stem alongside the socket and projecting radially outwardly from the stem 42. The flange 92 has an aperture 94 provided therein for receiving a strap (see 48 in FIGS. 3 and 4).

It is contemplated that, in use, the method and system of the present invention will involve initiation of permitted explosives in fiery environments such as coal mines, employing permitted shock tubes, whereby an initial shock tube is initiated by means of a permitted electrical initiator, and is used to propagate a detonation front to a connection device, which transfers the detonation front to a plurality of further permitted shock tubes, each of which propagates the detonation front to a permitted detonator, or a permitted booster/primer charge, for the initiation of the permitted explosive, which will typically be permitted packaged explosive, or a permitted emulsion explosive, as described above.

Accordingly, the polymer- or ceramic thick film technology type header will be used electrically to initiate the initial shock tube 30, using an initiating assembly 10 of the type shown in FIGS. 1 and 2. This propagates a detonation front along the initial shock tube 30, to a connection device 38 of the type shown in FIGS. 3 and 4, for transfer of the detonation front to a plurality of further shock tubes 56, in a blasting layout 76 of the type shown in FIG. 8. The further shock tubes 56 propagate detonation fronts to detonators for detonating blasting charges in the boreholes 78.

Instead, the initial shock tube 30 can propagate the detonation front to a connection device 58 of the type shown in FIGS. 5–7, in a blasting layout 84 of the type shown in FIG. 9, the detonation front being propagated via a series of connection devices 58 and via a series of initial/further shock tubes 30,56 to primer/booster charges in the various boreholes 78.

Naturally, hybrids of the aforegoing blasting methods and blasting systems can be employed, in accordance with the invention. In this regard it is to be noted that a primary feature of the invention is that transfer of the detonation front from the initial shock tube 30 to each further shock tube 56 takes place, both using the connection device 38 of FIGS. 3 and 4 or of FIGS. 10 and 11 and using the connection device 58 of FIG. 5–7, in a direction which is radial relative to the initial shock tube 30, and which is also radial relative to the further shock tubes 56. Furthermore, with particular reference to the connection device 38 of FIGS. 3 and 4 or of FIGS. 10 and 11, propagation of the detonation fronts along the further shock tubes 56 takes place in a longitudinal direction which is opposite to that in which the detonation front is propagated along the initial shock tube 30. The connection device 58 of FIGS. 5–7 can be used to connect the initial shock tube 30 to the further shock tubes 56 in a fashion so that the detonation fronts are propagated along the further shock tubes 56 either in the same direction as that of the detonation front in the initial shock tube 30, or, optionally, in the opposite direction. The advantage of the radial propagation of the detonation front from the initial shock tube and the association detonator (40 in FIGS. 3 and 4) or base charge (64 in FIGS. 5–7) is that detonation of said detonator or base charge can project fragments, particularly in an axial direction parallel to the direction of propagation of the detonation front along the initial tube, which fragments can cause cut-offs of the further shock tubes 56, if they are axially aligned with the detonator or base charge, as these fragments can be projected at higher initial velocities than the velocities of detonation fronts along the further shock tubes which detonation front velocities are typically no more than 2000 m/s. Further shock tube cut-offs have been a problem in conventional bunch block connectors whereby a detonator or base charge transfers a detonation from an initial shock tube to a bunch of further shock tubes axially aligned with the detonator.

The presence of the stem 42 (FIGS. 3 and 4 and FIGS. 10 and 11) which is typically of a plastics or elastomeric material attenuates propagation in a longitudinal direction of the detonation front from the end of the detonator to which the stem is attached. This can reinforce the propagation of the detonation in the radial direction, and, in the case where the further shock tubes propagate their detonation fronts in the same direction as that of the detonation front in the initial shock tube, this attenuation can reduce the possibility of cut-offs in the further shock tubes.

A further feature of the bunch-block type connection device shown in FIGS. 3 and 4 and FIGS. 10 and 11 is easy insertion thereof into a short borehole wherein it is stemmed, by virtue of the neat location of the further shock tube ends in the cup 46, which prevents the shock tube ends from snagging the periphery of the mouth of the borehole, and the strap 48 keeps the tubes neatly in place. In the case of FIGS. 3 and 4 the strap 48 is loose, but in the case of FIGS. 10 and 11 it passes through the aperture 94 in the flange 92, in which aperture it is held captive. Furthermore, in the embodiment of FIGS. 9 and 10 a detonator 40 (see FIGS. 3 and 4) is, before or after connection of the tube 30 thereto, simply pressed axially with a friction fit into the socket 86, via the open mouth 88 of the socket, the window 90 permitting inspection to ensure that the detonator is fully inserted.

It should further specifically be noted that, while the system, method and components of the system are particularly suitable, as described above, for permitted use, they can clearly be used for non-permitted uses using standard HMX/aluminium shock tubing in non-incendive atmospheres, or indeed in surface applications, while maintaining the advantages described above. Furthermore, while standard lengths of shock tubing may be used for the initial shock tube 30 and for the further shock tubes 56, various length of shock tubing can be interconnected to provide the initial shock tube 30 and further shock tubes 56, employing connectors of the type described in the Applicant's co-pending South African patent application 93/6410.

The Applicant has conducted successful preliminary trials employing the method and system of the present invention, details of which are set forth in the following Examples:

EXAMPLE 1

A simulated version of the initiation system shown in FIG. 8 was tested using twenty-five 3 m lengths of NONEL shock tube as the further shock tubes, and a 5 m length of NONEL shock tube as the initial shock tube. As the detonators initiated by the further shock tubes were used five of each of five different types of STATSAFE CARRICK detonators, namely five No 0 detonators, five No 1 detonators, five No 3 detonators, five No 4 detonators and five No 5 detonators.

As the detonator initiated by the initial shock tube, and forming part of the connection device (38 in FIGS. 3 and 4) was used a STATSAFE CARRICK No 0 detonator. The connection device 38 was simulated by connecting the No 0 detonator on the 5 m initial shock tube to the ends of the 3 m further shock tubes remote from their detonators, in the layout shown in FIG. 4, but omitting the stem 42 and cup 46, and using masking tape instead of the strap 48. Employing the layout of FIG. 8, the 5 m initial shock tube was initiated, resulting in initiation of all the detonators, with no mis-fires, which demonstrated the feasibility of the system and method of the present invention illustrated in FIG. 8, using the device of FIGS. 3 and 4.

EXAMPLE 2

A simulated version of the system shown in FIG. 9 was also tested. The bodies (60 in FIGS. 5–7) were made by modifying the bodies of ROP MINIDET mini-detonators (available from the Applicant) using a soldering iron, after removal of their caps, to provide the valleys 70, which were formed so that, at the bottom of each valley, the bodies 60 had a wall thickness of about 1 m to provide a break-out point for the detonation front. Metal detonating relay tubes with 50 mg lead azide charges were used for the tubes 62 (FIG. 7). The outwardly projecting free end of each tube 62 was crimped via its plug 66 to 2 m NONEL shock tube lengths.

Using masking tape instead of the clips 72 (which were omitted) a plurality of the devices 58 were connected in series via their associated shock tubes, the end of each shock tube remote from its associated device 58 being taped into the valley 70 of the preceding device 58. Each device 58 was associated with a steel pipe having a 35 mm inside diameter. Sixty devices 58 were connected together in series in this fashion. Each device 58 was also connected by the masking tape to a short length of NONEL shock tube,located in its valley 70, leading to a No 0 STATSAFE CARRICK detonator which was inserted in the associated steel tube, with the device 58 outside the pipe, except for the first device 58, which was connected in this fashion to two said detonators as shown in FIG. 9. Initiation of the first shock tube in the series lead to initiation of all the detonators in the steel tubes, with no shock tube pick-up failures, demonstrating the feasibility of the system and method as shown in FIG. 9, using the device of FIGS. 5–7.

From the aforegoing simulated trials described in Examples 1 and 2, with reference to the devices 58 and system 76 of FIGS. 3–4 and 8 respectively, and with reference to the devices 58 and system 84 of FIGS. 5–7 and 9 respectively, it appears that, at least with reference to the invention as illustrated in the drawings, the present invention provides a safe and reliable initiation system and method, and connection devices for use therein, which, although particularly suitable for permitted use, can also, naturally, be employed for non-permitted use.

We claim:

1. A system for the initiation of blasting which comprises:

an initial shock tube having, at one end thereof, an initiator connected thereto for the initiation of a detonation therein which propagates along its interior;

a connection device for connecting the initial shock tube, at a position remote from the initiator, to a plurality of further shock tubes and for transferring the detonation from the initial shock tube to the further shock tubes;

said plurality of further shock tubes for connection by the connection device to the initial shock tube, each for receiving a detonation transferred from the initial shock tube thereto by the connection device and for propagating the detonation to a charge of explosive in a borehole, said connection device is an assembly wherein a high explosive charge is a detonator with an end connected to the end of the initial shock tube, at the end of the initial shock tube remote from the initiator, the assembly comprising a securing strap for strapping each said further shock tubes to the detonator, whereby said further shock tubes are circumferentially disposed around the detonator, and extends alongside the detonator and initial shock tube substantially parallel thereto;

wherein said assembly includes a stem fast with the detonator of said assembly, said stem projecting axially away from an end of the detonator remote from the initial shock tube, said stem having an end remote from the detonator fast with a floor of a cup for receiving said ends of said further shock tubes, said remote end of the stem being located at a radially interior central position of said cup, the connection device comprising said high explosive charge for connection to, and initiation by, said initial shock tube at a position remote from the initiator, and means for holding a plurality of said further shock tubes in close proximity to said high explosive charge whereby said further shock tubes are held by said connection device, said further shock tubes parallel to said initial shock tube where said initial shock tube is connected to the high explosive charge and spaced radially therefrom, and so that any transfer of a detonation from said initial shock tube to the further shock tubes takes place in a direction which is radial relative to the initial shock tube and radial relative to the further shock tubes.

* * * * *